US007003450B2

(12) United States Patent
Sadri et al.

(10) Patent No.: US 7,003,450 B2
(45) **Date of Patent: *Feb. 21, 2006**

(54) METHODS AND APPARATUS FOR EFFICIENT VOCODER IMPLEMENTATIONS

(75) Inventors: Ali Soheil Sadri, Cary, NC (US); Navin Jaffer, Chapel Hill, NC (US); Anissim A. Silivra, Chapel Hill, NC (US); Bin Huang, Chapel Hill, NC (US); Matthew Plonski, Morrisville, NC (US)

(73) Assignee: PTS Corporation, San Jose, CA (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 852 days.

(21) Appl. No.: 10/013,908

(22) Filed: Oct. 19, 2001

(65) Prior Publication Data

US 2002/0165709 A1 Nov. 7, 2002

Related U.S. Application Data

(60) Provisional application No. 60/241,940, filed on Oct. 20, 2000.

(51) Int. Cl.
*G10L 21/00* (2006.01)

(52) U.S. Cl. ..... 704/201; 704/500; 704/221; 712/222

(58) Field of Classification Search ..... 704/201, 704/500, 221; 712/222
See application file for complete search history.

(56) References Cited

U.S. PATENT DOCUMENTS

| | | | | |
|---|---|---|---|---|
| 5,784,532 A * | 7/1998 | McDonough et al. | ..... | 704/224 |
| 5,893,066 A * | 4/1999 | Hong | ..... | 704/500 |
| 5,966,528 A * | 10/1999 | Wilkinson et al. | ..... | 712/222 |
| 6,073,100 A * | 6/2000 | Goodridge, Jr. | ..... | 704/258 |
| 6,425,054 B1 * | 7/2002 | Nguyen | ..... | 711/117 |

* cited by examiner

*Primary Examiner*—David D. Knepper
*Assistant Examiner*—Qi Han
(74) *Attorney, Agent, or Firm*—Priest & Goldstein, PLLC

(57) ABSTRACT

Techniques for implementing vocoders in parallel digital signal processors are described. A preferred approach is implemented in conjunction with the BOPS® Manifold Array (ManArray™) processing architecture so that in an array of N parallel processing elements, N channels of voice communication are processed in parallel. Techniques for forcing vocoder processing of one data-frame to take the same number of cycles are described. Improved throughput and lower clock rates can be achieved.

10 Claims, 6 Drawing Sheets

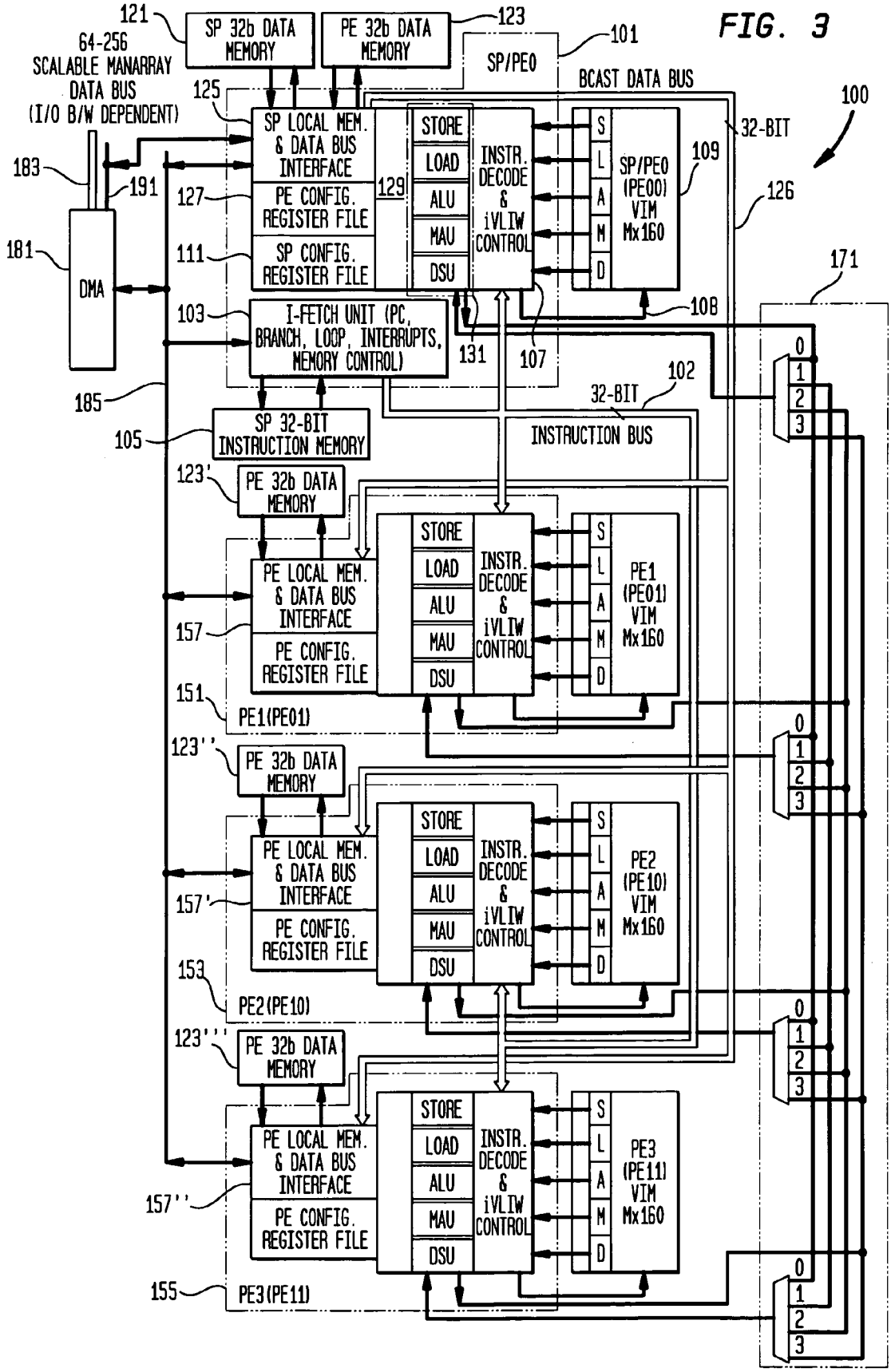
FIG. 3
100
121
SP 32b DATA MEMORY
PE 32b DATA MEMORY
123
101
SP/PE0
64-256 SCALABLE MANARRAY DATA BUS (I/O B/W DEPENDENT)
BCAST DATA BUS
125
SP LOCAL MEM. & DATA BUS INTERFACE
STORE
LOAD
ALU
MAU
DSU
INSTR. DECODE & iVLIW CONTROL
S
L
A
M
D
SP/PE0 (PE00) VIM Mx160
32-BIT
109
126
183
191
127
PE CONFIG. REGISTER FILE
129
181
DMA
111
SP CONFIG. REGISTER FILE
171
103
I-FETCH UNIT (PC, BRANCH, LOOP, INTERRUPTS, MEMORY CONTROL)
108
131
107
102
32-BIT
185
SP 32-BIT INSTRUCTION MEMORY
105
INSTRUCTION BUS
123'
PE 32b DATA MEMORY
PE LOCAL MEM. & DATA BUS INTERFACE
157
PE CONFIG. REGISTER FILE
PE1 (PE01) VIM Mx160
151
PE1(PE01)
123''
PE 32b DATA MEMORY
157'
PE2 (PE10) VIM Mx160
153
PE2(PE10)
123'''
PE 32b DATA MEMORY
157''
PE3 (PE11) VIM Mx160
155
PE3(PE11)
0
1
2
3

FIG. 5

500

| |
|---|
| start_ENCODER_saved |
| ENCODER_checksum |
| start_ENCODER_output |
| prm [ PRM_SIZE + 1 ] |
| end_ENCODER_output<br>... |
| start_ENCODER_input |
| old_speech [ L_TOTAL + 12 ] |
| end_ENCODER_input |
| start_ECHOCANCELLER_buffer |
| start_ECHOCANCELLER_input |
| end_ECHOCANCELLER_buffer |
| start_DECODER_saved |
| DECODER_checksum<br>... |
| TABLE_LOCATION<br>... |
| end_ENCODER_saved<br>... |
| start_DECODER_output |
| synth [ L_FRAME + M ] |
| end_DECODER_output |
| start_DECODER_input |
| parm [ PRM_SIZE + 1 ] |
| end_DECODER_input<br>... |
| end_DECODER_saved |
| encoder/decoder other variables |
| temp_scratch_pad<br>... |
| end_var |

FIG. 6

600

| MODULE | PERFORMANCE MEASURE | SEQUENTIAL (610) | iVLIW (620) |
|---|---|---|---|
| ENCODER | CYCLES PER FRAME | 151.1K | 73.5K |
| | SP INSTRUCTION MEMORY (HEX BYTES) | 5794 | 6050 |
| | SP DATA MEMORY (HEX BYTES) | 35C | 35C |
| | PE DATA MEMORY (HEX BYTES) | 2F3F | 2F3F |
| | VLIW MEMORY (HEX BYTES) | 0 | 500 |
| DECODER | CYCLES PER FRAME | 30.1K | 13K |
| | SP INSTRUCTION MEMORY (HEX BYTES) | 2444 | 2898 |
| | SP DATA MEMORY (HEX BYTES) | 35C | 35C |
| | PE DATA MEMORY (HEX BYTES) | 2AE7 | 2AE7 |
| | VLIW MEMORY (HEX BYTES) | 0 | 500 |
| ENCODER + DECODER | CYCLES PER FRAME | 181.2K | 86.5K |
| | SP INSTRUCTION MEMORY (HEX BYTES) | 7334 | 8200 |
| | SP DATA MEMORY (HEX BYTES) | 59C | 59C |
| | PE DATA MEMORY (HEX BYTES) | 32C0 | 32C0 |
| | VLIW MEMORY (HEX BYTES) | 0 | 500 |

METHODS AND APPARATUS FOR EFFICIENT VOCODER IMPLEMENTATIONS

CROSS-REFERENCE TO RELATED APPLICATIONS

The present application claims the benefit of U.S. Provisional Application Ser. No. 60/241,940 filed Oct. 20, 2000 and entitled "Methods and Apparatus for Efficient Vocoder Implementations" which is incorporated by reference herein in its entirety.

FIELD OF THE INVENTION

The present invention relates generally to improvements in parallel processing. More particularly, the present invention addresses methods and apparatus for efficient implementation of vocoders in parallel DSPs. In a presently preferred embodiment, these techniques are employed in conjunction with the BOPS® Manifold Array (ManArray™) processing architecture.

BACKGROUND OF THE INVENTION

In the present world, the telephone is a ubiquitous way to communicate. Besides the original telephone configuration now there are cellular phones, satellite phones, and the like. In order to increase throughput of the telephone communication network, vocoders are typically used. A vocoder compresses the voice using some model for a voice producing mechanism. A compressed or encoded voice is transmitted over a communication system and needs to be decompressed or decoded on the other end. The nature of most voice communication applications requires the encoding and decoding of voice to be done in real time, which is usually performed by digital signal processors (DSPs) running a vocoder.

A family of vocoders, such as vocoders for use in connection with G.723, G.726/727, G.729 standards, as well as others, have been designed and standardized for telephone communication in accordance with the International Telecommunications Union (ITU) Recommendations. See, for example, R. Salami, C. Laflamme, B. Besette, and J-P. Adoul, ITU-T G.729Annex A: Reduced Complexity 8 kb/s CS-ACELP Codec for Digital Simultaneous Voice and Data, *IEEE Communications Magazine,* September 1997, pp. 56–63 which is incorporated by reference herein in its entirety. These vocoders process a continuous stream of digitized audio information by frames, where a frame typically contains 10 to 20 ms of audio samples. See, for example, the reference cited above, as well as, J. Du, G. Warner, E. Vallow, and T. Hollenbach, Using DSP16000 for GSM EFR Speech Coding, *IEEE Signal Processing Magazine,* March 2000, pp. 16–26 which is incorporated by reference in its entirety. These vocoders employ very sophisticated DSP algorithms involving computation of correlations, filters, polynomial roots and so on. A block diagram of a G.729a encoder 10 is shown in FIG. 1 as exemplary of the complexity and internal links between different parts of a typical prior art vocoder.

The G.729a vocoder is based on the code-excited linear-prediction (CELP) coding model described in the Salami et al. publication cited above. The encoder operates on speech frames of 10 ms corresponding to 80 samples at a sampling rate of 8000 samples per second. For every 10 ms frame, with a look-ahead of 5 ms, the speech signal is analyzed to extract the parameters of the CELP model such as linear-prediction filter coefficients, adaptive and fixed-codebook indices and gains. Then, the parameters, which take up only 80 bits compared to the original voice samples which take up 80*16 bits, are transmitted. At the decoder, these parameters are used to retrieve the excitation and synthesis filter parameters. The original speech is reconstructed by filtering this excitation through the short-term synthesis filter based on a 10th order linear prediction (LP) filter. A long-term, or pitch synthesis filter is implemented using the so-called adaptive-codebook approach. After computing the reconstructed speech, it is further enhanced by a post-filter.

A well known implementation of a G.729a vocoder, for example, takes on average about 50,000 cycles per channel per frame. See for example, S. Berger, Implement a Single Chip, Multichannel VoIP DSP Engine, *Electronic Design,* May 15, 2000, pp. 101–106. As a result, processing multiple voice channels at the same time, which is usually necessary at communication switches, requires great computational power. The traditional way to meet this requirement are by increasing the DSP clock frequency or the number of DSPs with multiple DSPs operating in parallel, each DSP has to be able to operate independently to handle conditional jumps, data dependency, and the like. As the DSPs do not operate in synchronism, there is a high overhead for multiple clocks, control circuitry and the like. In both cases, increased power, higher manufacturing costs, and the like result.

It will be shown in the present invention that a high performance vocoder implementation can be designed for parallel DSPs such as BOPS® ManArray™ family with many advantages over the typical prior art approaches discussed above. Among its other advantages, the parallelization of vocoders using the BOPS® ManArray™ architecture results in an increase in the number of communication channels per DSP.

SUMMARY OF THE INVENTION

The ManArray™ DSP architecture as programmed herein provides a unique possibility to process the voice communication channels in parallel instead of in sequence. Details of the ManArray™ 2×2 architecture are shown in FIGS. 2 and 3, and are discussed further below. An important aspect of this architecture as utilized in the present invention is that it has multiple parallel processing elements (PEs) and one sequential processor (SP). Together, these processors operate as a single instruction multiple data (SIMD) parallel processor array. An instruction executed on the array performs the same function on each of the PEs. Processing elements can communicate with each other and with the SP through a cluster switch (CS). It is possible to distribute input data across the PEs, as well as exchange computed results between PEs or between PEs and the SP. Thus, individual PEs can either perform on different parts of input data to reduce the total execution time or on independent data sets.

Thus, if a DSP in accordance with this invention has N parallel PEs, it is capable of processing N channels of voice communication at a time in parallel. To achieve this end, according to one aspect of the present invention, the following steps have been taken:

- the C code has been adapted to permit implementation of a function without using conditional jumps from one part of the function to another and/or conditional returns from a function
- individual functions are implemented in a non-data dependent way so that they always take the same number of cycles regardless of what data are processed
- control code to be run on the SP is separated from data processing code to be run on the PEs.

These and other advantages and aspects of the present invention will be apparent from the drawings and the Detailed Description including the Tables which follow below.

BRIEF DESCRIPTION OF THE DRAWINGS

FIG. 3 illustrates further details of a 2×2 ManArray™ architecture suitable for use in accordance with the present invention;

FIG. 5 illustrates a processing element data memory set up in accordance with the present invention; and FIG. 6 is a table comparing Manta 1×1 sequential processing and an iVLIW implementation.

DETAILED DESCRIPTION

Figure 1:
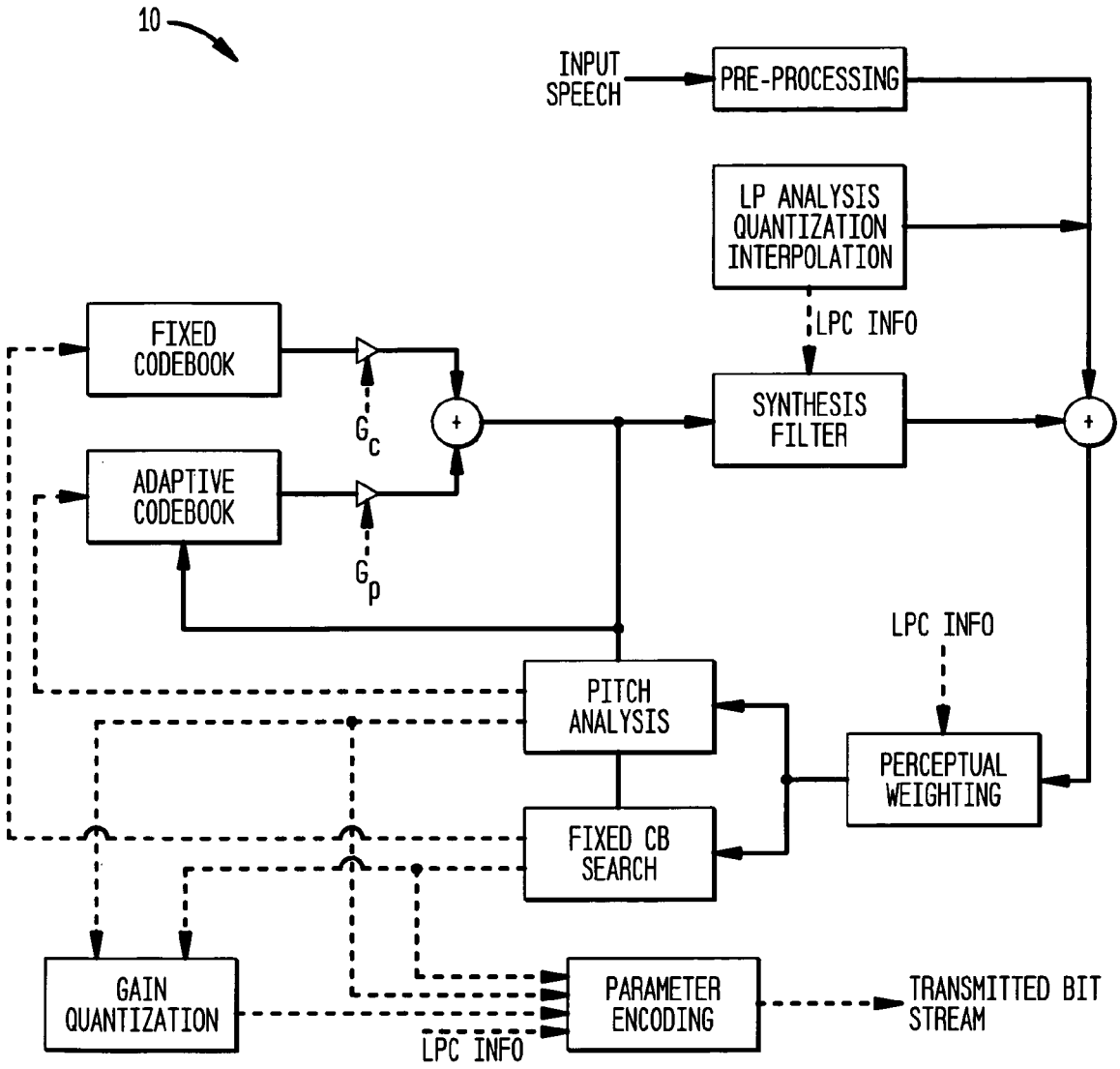
FIG. 1 (PRIOR ART)
FIG. 1 shows a block diagram of a prior art G.729a encoder.

Further details of a presently preferred ManArray core, architecture, and instructions for use in conjunction with the present invention are found in U.S. patent application Ser. No. 08/885,310 filed Jun. 30, 1997, now U.S. Pat. No. 6,023,753, U.S. patent application Ser. No. 08/949,122 filed Oct. 10, 1997, now U.S. Pat. No. 6,167,502, U.S. patent application Ser. No. 09/169,255 filed Oct. 9, 1998, U.S. patent application Ser. No. 09/169,256 filed Oct. 9, 1998, now U.S. Pat. No. 6,167,501, U.S. patent application Ser. No. 09/169,072 filed Oct. 9, 1998, U.S. patent application Ser. No. 09/187,539 filed Nov. 6, 1998, now U.S. Pat. No. 6,151,668, U.S. patent application Ser. No. 09/205,558 filed Dec. 4, 1998, now U.S. Pat. No. 6,173,389, U.S. patent application Ser. No. 09/215,081 filed Dec. 18, 1998, now U.S. Pat. No. 6,101,592, U.S. patent application Ser. No. 09/228,374 filed Jan. 12, 1999 now U.S. Pat. No. 6,216,223, U.S. patent application Ser. No. 09/238,446 filed Jan. 28, 1999, U.S. patent application Ser. No. 09/267,570 filed Mar. 12, 1999, U.S. patent application Ser. No. 09/337,839 filed Jun. 22, 1999, U.S. patent application Ser. No. 09/350,191 filed Jul. 9, 1999, U.S. patent application Ser. No. 09/422,015 filed Oct. 21, 1999 entitled "Methods and Apparatus for Abbreviated Instruction and Configurable Processor Architecture", U.S. patent application Ser. No. 09/432,705 filed Nov. 2, 1999 entitled "Methods and Apparatus for Improved Motion Estimation for Video Encoding", U.S. patent application Ser. No. 09/471,217 filed Dec. 23, 1999 entitled "Methods and Apparatus for Providing Data Transfer Control", U.S. patent application Ser. No. 09/472,372 filed Dec. 23, 1999 entitled "Methods and Apparatus for Providing A Direct Memory Access Control", U.S. patent application Ser. No. 09/596,103 entitled "Methods and Apparatus for Data Dependent Address Operations and Efficient Variable Length Code Decoding in a VLIW Processor" filed Jun. 16, 2000, U.S. patent application Ser. No. 09/598,567 entitled "Methods and Apparatus for Improved Efficiency in Pipeline Simulation and Emulation" filed Jun. 21, 2000, U.S. patent application Ser. No. 09/598,564 entitled "Methods and Apparatus for Initiating and Resynchronizing Multi-Cycle SIMD Instructions" filed Jun. 21, 2000, U.S. patent application Ser. No. 09/598,566 entitled "Methods and Apparatus for Generalized Event Detection and Action Specification in a Processor" filed Jun. 21, 2000, and U.S. patent application Ser. No. 09/598,084 entitled "Methods and Apparatus for Establishing Port Priority Functions in a VLIW Processor" filed Jun. 21, 2000, U.S. patent application Ser. No. 09/599,980 entitled "Methods and Apparatus for Parallel Processing Utilizing a Manifold Array (ManArray) Architecture and Instruction Syntax" filed Jun. 22, 2000, U.S. patent application Ser. No. 09/791,940 entitled "Methods and Apparatus for Providing Bit-Reversal and Multicast Functions Utilizing DMA Controller" filed Feb. 23, 2001, U.S. patent application Ser. No. 09/792,819 entitled "Methods and Apparatus for Flexible Strength Coprocessing Interface" filed Feb. 23, 2001, U.S. patent application Ser. No. 09/792,256 entitled "Methods and Apparatus for Scalable Array Processor Interrupt Detection and Response" filed Feb. 23, 2001, as well as, Provisional Application Ser. No. 60/113,637 entitled "Methods and Apparatus for Providing Direct Memory Access (DMA) Engine" filed Dec. 23, 1998, Provisional Application Ser. No. 60/113,555 entitled "Methods and Apparatus Providing Transfer Control" filed Dec. 23, 1998, Provisional Application Ser. No. 60/139,946 entitled "Methods and Apparatus for Data Dependent Address Operations and Efficient Variable Length Code Decoding in a VLIW Processor" filed Jun. 18, 1999, Provisional Application Ser. No. 60/140,245 entitled "Methods and Apparatus for Generalized Event Detection and Action Specification in a Processor" filed Jun. 21, 1999, Provisional Application Ser. No. 60/140,163 entitled "Methods and Apparatus for Improved Efficiency in Pipeline Simulation and Emulation" filed Jun. 21, 1999, Provisional Application Ser. No. 60/140,162 entitled "Methods and Apparatus for Initiating and Re-Synchronizing Multi-Cycle SIMD Instructions" filed Jun. 21, 1999, Provisional Application Ser. No. 60/140,244 entitled "Methods and Apparatus for Providing One-By-One Manifold Array (1×1 ManArray) Program Context Control" filed Jun. 21, 1999, Provisional Application Ser. No. 60/140,325 entitled "Methods and Apparatus for Establishing Port Priority Function in a VLIW Processor" filed Jun. 21, 1999, Provisional Application Ser. No. 60/140,425 entitled "Methods and Apparatus for Parallel Processing Utilizing a Manifold Array (ManArray) Architecture and Instruction Syntax" filed Jun. 22, 1999, Provisional Application Ser. No. 60/165,337 entitled "Efficient Cosine Transform Implementations on the ManArray Architecture" filed Nov. 12, 1999, and Provisional Application Ser. No. 60/171,911 entitled "Methods and Apparatus for DMA Loading of Very Long Instruction Word Memory" filed Dec. 23, 1999, Provisional Application Ser. No. 60/184,668 entitled "Methods and Apparatus for Providing Bit-Reversal and Multicast Functions Utilizing DMA Controller" filed Feb. 24, 2000, Provisional Application Ser. No. 60/184,529 entitled "Methods and Apparatus for Scalable Array Processor Interrupt Detection and Response" filed Feb. 24, 2000, Provisional Application Ser. No. 60/184,560 entitled "Methods and Apparatus for Flexible Strength Coprocessing Interface" filed Feb. 24, 2000, Provisional Application Ser. No. 60/203,629 entitled "Methods and Apparatus for Power Control in a Scalable Array of Processor Elements" filed May 12, 2000, Provisional Application Ser. No. 60/241,940 entitled "Methods and Apparatus for Efficient Vocoder Implementations" filed Oct. 20, 2000, Provisional Application Serial No. 60/251,072 entitled "Methods and Apparatus for Providing Improved Physical Designs and Routing with Reduced Capacitive Power Dissipation" filed Dec. 4, 2000, Provisional Application Ser. No. 60/281,523 entitled "Methods and Apparatus for Generating Functional Test Programs by Traversing a Finite State Model of Instruction Set Architecture" filed Apr. 4, 2001, Provisional Application Ser. No. 60/283,582 entitled "Methods and Apparatus for Automated Generation of Abbreviated Instruction Set and Configurable Processor Architecture" filed Apr. 27, 2001, Provisional Application Ser. No. 60/288,965 entitled "Methods and Apparatus for Removing Compression Artifacts in Video Sequences" filed May 4, 2001, Provisional Application Serial No. 60/298,696 entitled "Methods and Apparatus for Generalized Event Detection and Action Specification in a Processor for Providing Embedded Exception Handling" filed Jun. 15, 2001, and Provisional Application Ser. No. 60/298,695 entitled "Methods and Apparatus for Self Tracking Read Delay Write for Low Power Memory" filed Jun. 15, 2001, and Provisional Application Ser. No. 60/298,624 entitled "Modified Single Ended Write Approach for Multiple Write-Port Register Files" filed Jun. 15, 2001, all of which are assigned to the assignee of the present invention and incorporated by reference herein in their entirety.

Figure 2:
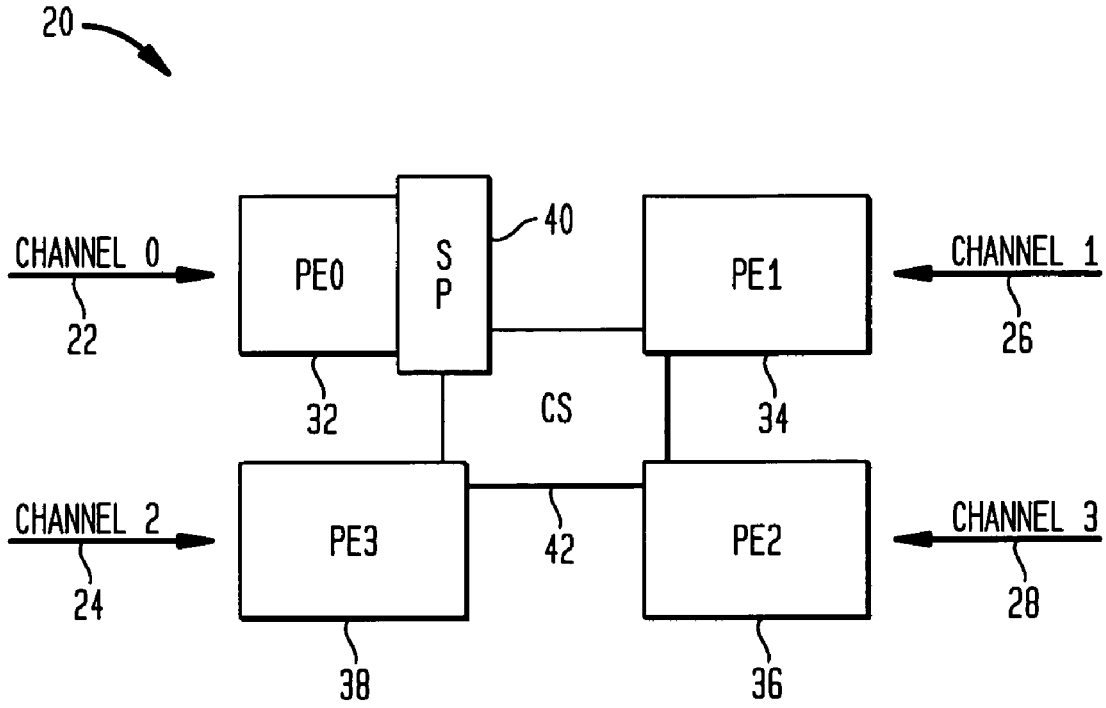
FIG. 2 illustrates a simplified block diagram of a Manta™ 2×2 architecture in accordance with the present invention.

Turning to specific aspects of the present invention, FIG. 2 illustrates a simplified block diagram of a ManArray 2×2 processor 20 for processing four voice conversations or channels 22, 24, 26, 28 in parallel utilizing PE0 31, PE1 34, PE2 36, PE3 38 and SP 40 connected by a cluster switch CS 42. The advantages of this approach and exemplary code are addressed further below following a more detailed discussion of the ManArray™ processor.

In a presently preferred embodiment of the present invention, a ManArray™ 2×2 iVLIW single instruction multiple data stream (SIMD) processor 100 shown in FIG. 3 contains a controller sequence processor (SP) combined with processing element-0 (PE0) SP/PE0 101, as described in further detail in U.S. application Ser. No. 09/169,072 entitled "Methods and Apparatus for Dynamically Merging an Array Controller with an Array Processing Element". Three additional PEs 151, 153, and 155 are also utilized to demonstrate improved parallel array processing with a simple programming model in accordance with the present invention. It is noted that the PEs can be also labeled with their matrix positions as shown in parentheses for PE0 (PE00) 101, PE1 (PE01) 151, PE2 (PE10) 153, and PE3 (PE11) 155. The SP/PE0 101 contains a fetch controller 103 to allow the fetching of short instruction words (SIWs) from a 32-bit instruction memory 105. The fetch controller 103 provides the typical functions needed in a programmable processor such as a program counter (PC), branch capability, digital signal processing loop operations, support for interrupts, and also provides the instruction memory management control which could include an instruction cache if needed by an application. In addition, the SIW I-Fetch controller 103 dispatches 32-bit SIWs to the other PEs in the system by means of a 32-bit instruction bus 102.

In this exemplary system, common elements are used throughout to simplify the explanation, though actual implementations are not so limited. For example, the execution units 131 in the combined SP/PE0 101 can be separated into a set of execution units optimized for the control function, for example, fixed point execution units, and the PE0 as well as the other PEs 151, 153 and 155 can be optimized for a floating point application. For the purposes of this description, it is assumed that the execution units 131 are of the same type in the SP/PE0 and the other PEs. In a similar manner, SP/PE0 and the other PEs use a five instruction slot iVLIW architecture which contains a very long instruction word memory (VIM) memory 109 and an instruction decode and VIM controller function unit 107 which receives instructions as dispatched from the SP/PE0's I-Fetch unit 103 and generates the VIM addresses-and-control signals 108 required to access the iVLIWs stored in the VIM. These iVLIWs are identified by the letters SLAMD in VIM 109. The loading of the iVLIWs is described in further detail in U.S. patent application Ser. No. 09/187,539 entitled "Methods and Apparatus for Efficient Synchronous MIMD Operations with iVLIW PE-to-PE Communication". Also contained in the SP/PE0 and the other PEs is a common PE configurable register file 127 which is described in further detail in U.S. patent application Ser. No. 09/169,255 entitled "Methods and Apparatus for Dynamic Instruction Controlled Reconfiguration Register File with Extended Precision".

Due to the combined nature of the SP/PE0, the data memory interface controller 125 must handle the data processing needs of both the SP controller, with SP data in memory 121, and PE0, with PE0 data in memory 123. The SP/PE0 controller 125 also is the source of the data that is sent over the 32-bit broadcast data bus 126. The other PEs 151, 153, and 155 contain common physical data memory units 123', 123", and 123'" though the data stored in them is generally different as required by the local processing done on each PE. The interface to these PE data memories is also a common design in PEs 1, 2, and 3 and indicated by PE local memory and data bus interface logic 157, 157' and 157". Interconnecting the PEs for data transfer communications is the cluster switch 171 more completely described in U.S. patent application Ser. No. 08/885,310 entitled "Manifold Array Processor", U.S. patent application Ser. No. 09/949,122 entitled "Methods and Apparatus for Manifold Array Processing", and U.S. patent application Ser. No. 09/169,256 entitled "Methods and Apparatus for ManArray PE-to-PE Switch Control". The interface to a host processor, other peripheral devices, and/or external memory can be done in many ways. The primary mechanism shown for completeness is contained in a direct memory access (DMA) control unit 181 that provides a scalable ManArray data bus 183 that connects to devices and interface units external to the ManArray core. The DMA control unit 181 provides the data flow and bus arbitration mechanisms needed for these external devices to interface to the ManArray core memories via the multiplexed bus interface represented by line 185. A high level view of a ManArray Control Bus (MCB) 191 is also shown.

Turning now to specific details of the ManArray™ architecture and instruction syntax as adapted by the present invention, this approach advantageously provides a variety of benefits. Specialized ManArray™ instructions and the capability of this architecture and syntax to use an extended precision representation of numbers (up to 64 bits) make it possible to design a vocoder so that the processing of one data-frame always takes the same number of cycles.

The adaptive nature of vocoders makes the voice processing data dependent in prior art vocoder processing. For example, in the Autocorr function, there is a processing block that shifts down input data and repeats computation of the zeroeth correlation coefficient until the correlation coefficient stops overflow the 32-bit format. Thus, the number of repetitions is dependent on the input data. In the ACELP_Code_A function, the number of filter coefficients to be updated equals either (T0−L_SUBFR) if the computed value of T0<L_SUBFR or 0 otherwise. Thus processing is data dependent varying depending upon the value of TO. In the Pitch_fr3_fast function, the fractional pitch search −⅓ and +⅓ is not performed if the computed value of T0>84 for the first sub-frame in the frame. Again, processing is clearly data dependent. Therefore, processing of a particular frame of speech requires a different number of arithmetical operations depending on the frame data which determine what kind of conditions have been or have not been triggered in the current and, generally, the previous sub-frame.

The following example taken from the function Az_lsp (which is part of LP analysis, quantization, interpolation in FIG. 1) illustrates how the present invention (1) changes the standard C code to permit implementation of a function without using conditional jumps from one part of the function to another and/or conditional returns from a function, and (2) individual functions are implemented in a non data dependent way (so that they always take the same number of cycles regardless of what data are processed).

```
ITU Standard Code
while ((nf<M) && (j<GRID_POINTS))
{
    j++;
    {
        do_something:
    }
}
```

is changed under the present invention to the following:

```
for( j=0; j<GRID_POINTS;j++)
{
    if ( nf<M)
    {
        do_something;
    }
    else
    {
        do_nothing; /* takes the same number of
        operations as do_something
                    /* with no effect on data and variables,
                    "idle" processing
    }
}
```

Usage of the for-loop makes the process free of conditional parts, and usage of the if-else structure synchronizes execution of this code for different input data.

The following example taken from the function Autocorr (part of LP analysis, quantization, interpolation in FIG. 1) illustrates another technique, according to the present invention which is suitable for eliminating data dependency.

```
    ITU Standard Code
do {                        /* Compute r[0] and test for overflow */
    Overflow = 0;
    sum = 1;                /* Avoid case of all zeros */
    for(i=0; i<L_WINDOW; i++)
        sum = L_mac(sum, y[i], y[i]);
    if(Overflow != 0)       /* If overflow divide y[] by 4 */
    {
        for(i=0; i<L_WINDOW; i++)
        {
            y[i] = shr(y[i], 2);
        }
    }
}while (Overflow != 0);
```

may be advantageously implemented in the following way in a ManArray™ DSP:

```
(Word64)sum = 1;            /* Avoid case of all zeros */
for(i=0; i<L_WINDOW; i++)
    (Word64)sum = (Word64)L_mac((Word64)sum, y[i], y[i]);
N =  norm((Word64)sum);     /* Determine number of
N =  ceil(shr(N-30, 2));    bits in sum */
if (N < 0) N = 0;
for(i=0; i<L_WINDOW; i++)
{
    y[i] = shr(y[i], 2N);
}
```

In the latter implementation, two ManArray™ features are highly advantageous. The first one is the capability to use 64-bit representations of numbers (Word64) both for storage and computation. The other one is the availability of specialized instructions such as a bit-level instruction to determine the highest bit that is on in a binary representation of a number (N=norm((Word64)sum)). Utilizing and adapting these features, the above implementation always requires the same number of cycles. Incidentally, this approach is more efficient because it makes possible the elimination of an exhaustive and non-deterministic do { . . . } while (Overflow !=0) loop.

Thus, implementation of the first two changes makes it possible to create a control code common for all PEs. In other words, all loops start and end at the same time, a new function is called synchronously for all PEs, etc. Redesigned vocoder control structure and the availability of multiple processing elements (PEs) in the ManArray™ DSP architecture make possible the processing of several different voice channels in parallel.

Parallelization of vocoder processing for a DSP having N processing elements has several advantages, namely:

- It increases the number of channels per DSP or total system throughput.
- The clock rate can be lower than is typically used in voice processing chips thereby lowering overall power usage.
- Additional power savings can be achieved by turning a PE off when it has finished processing but some other PEs are still processing data.

An implementation of the G729a vocoder takes about 86,000 cycles utilizing a ManArray 1×2 configuration for processing two voice channels in parallel. Thus, the effective number of cycles needed for processing of one channel is 43,000, which is a highly efficient implementation. The implementation is easily scalable for a larger number of PEs, and in the 2×2 ManArray configuration the effective number of cycles per channel would be about 21,500.

Further details of a presently preferred implementation of a G.729A reduced complexity of 8 kbit/s CS-ACELP Speech Codec follow below. Sequential code follows as Table I and iVLIW code follows as Table II.

In one embodiment of the present invention, the ANSI-c Source Code, Version 1.1, September 1996 of Annex A to ITU-T Recommendation G.729, G.729A, was implemented on the BOPS, Inc. Manta co-processor core. G.729A is a reduced complexity 8 kilobits per second (kbps) speech coder that uses conjugate structure algebraic-code-exited linear-prediction (CS-ACELP) developed for multimedia simultaneous voice and data applications. The coder assumes 16-bit linear PCM input.

The Manta co-processor core combines four high-performance 32-bit processing elements (PE0, 1,2,3) with a high performance 32-bit sequence processor (SP). A high-performance DMA, buses and scalable memory bandwidth also complement the core. Each PE has five execution units: a MAU, an ALU, a DSU, and LU and an SU. The ALU, MAU and DSU on each PE support both fixed-point and single-precision floating-point operations. The SP, which is merged with PE0, has it's own five execution units: an MAU, an ALU, a DSU, an LU, and an SU. The SP also includes a program flow control unit (PCFU), which performs instruction address generation and fetching, provides branch control, and handles interrupt processing.

Each SP and each PE on the Manta use an indirect very long instruction word (iVLIW™) architecture. The iVLIW design allows the programmer to create optimized instructions for specific applications. Using simple 32-bit instruction paths, the programmer can create a cache of application-optimized VLIWs in each PE. Using the same 32-bit paths, these iVLIWs are triggered for execution by a single instruction, issued across the array. Each iVLIW is composed by loading and concatenating five 32-bit simplex instructions in each PE's iVLIW instruction memory (VIM). Each of the five individual instruction slots can be enabled and disabled independently. The ManArray programmer can selectively mask PEs in order to maximize the usage of available parallelism. PE masking allows a programmer to selectively operate any PE. A PE is masked when its corresponding PE mask bit in SP SCR1 is set. When a PE is masked, it still receives instructions, but it does not change its internal register state. All instructions check the PE mask bits during the decode phase of the pipeline.

Figure 4:
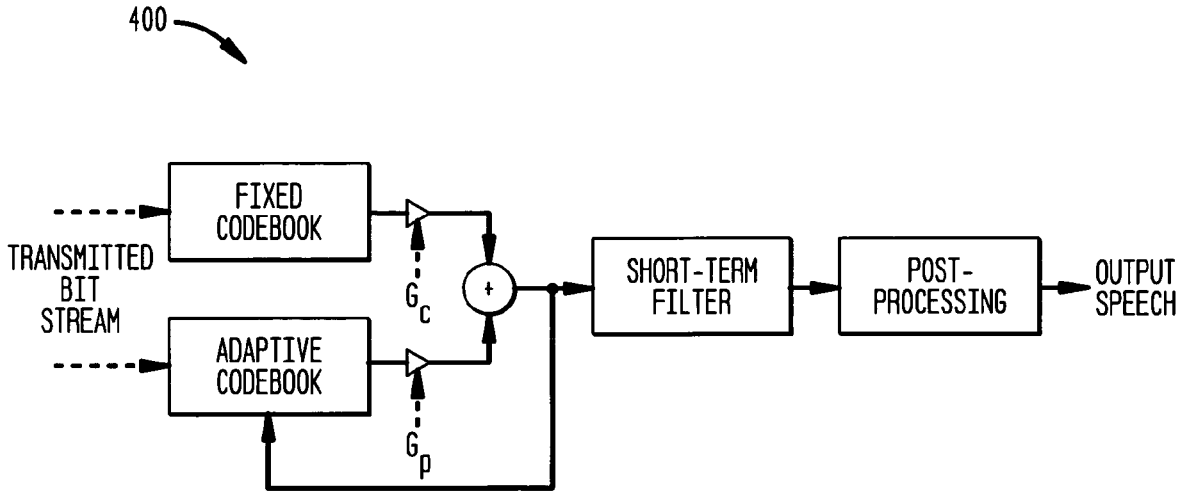
FIG. 4 (PRIOR ART)
FIG. 4 shows a block diagram of a prior art G.729a decoder.

The prior art CS-ACELP coder is based on code excited linear-prediction (CELP) coding model discussed in greater detail above. A block diagram for an exemplary G.729A encoder 10 is shown in FIG. 1 and discussed above. A corresponding prior art decoder 400 is shown in FIG. 4.

The overall Manta program set-up in accordance with one embodiment of the present invention is summarized as follows.

The calculations and any conditional program flow are done entirely on the PE for scalability.

eploopi3 is used in the main loops of the functions coder and decoder. eploopi2 is used in the main loops of the functions Coder_1d8a and Decod_1d8a.2.

SP A0–A1 and PE A0–A1 are used for pointing to input and output of coder.s or decoder.s.

PE A2 points to the address of encoded parameters, PRM[ ] in the encoder or parm[ ] in the decoder.

PE R0–R9 are used for debug and most often used constants or variables defined as follows:

| | |
|---|---|
| PE R0, R1, R2 | = DMA or debut or system |
| PE R3 | = +332768 or 0x000080000 |
| PE R4 and R5 | = 0 |
| PE R6 | = +2147483647 or 0x7FFFFFFF |
| PE R7 | = −2147483648 or 0x800000000 |
| PE R8 | = frame |
| PE R9 | = i_subfr |

SP/PE R10–R31, PE A3–A7 and SP A2–A6 are available for use by any function as needed for input or as scratch registers.

Sp A7 is used for pushing/popping the address to return to after a call on a stack defined in SP memory by the symbol ADDR_ULR_Stack in the file globalMem.s. The current stack pointer is saved in the SP memory location defined by the symbol ADDR_ULR_STACK_TOP_PTR in the file globalMem.s. The macros Push_ULR spar and Pop_ULR spar, which are defined in 1d8A_h.s, are to be used at the beginning and end of each function for pushing/popping the address to return to after a call.

The macros PEx_ON Pemask and PEs_OFF Pemask, which are defined in 1d8a_h.s, are used to mask on/off Pes are required.

If two 16-bit variables were used for a 32-bit variable in the ITU C-code (i.e., r_h and r_l), 32-bit memory stores, loads and calculations were used in Manta instead (i.e., r).

The sequential and iVLIW code are rigorously tested with the test vectors obtained from the ITU and VoiceAge to ensure that given the same input as for the ITU C source code, the assembly code provides the same bit-exact output.

The file 1d_8ah.s contains all constants and macros defined in the ITU C source code file 1d8A.h. It also controls how many frames are processed using the constant NUM-FRAMES.

The file 1d_8Ah.s contains all constants and macros defined in the ITU C source code file 1d8a.h. It also controls how many frames are processed using the constant NUM-FRAMES.

The file globalMem.s contains all global tables and global data memory defined. Most of the tables are in SP memory, but some were moved to PE memory as needed to reduce the number of cycles. A lot of the functions use temporary memory that starts with the symbol temp_scratch_pad. The assumption is that after a particular function uses that temporary memory, it is available to any function after it. If a variable or table needs to be aligned on a word or double word boundary, it is explicitly defined that way by using the align instruction.

The PE data memory, defined in globalMem.s, is set up as shown in the table 500 of FIG. 5 in order to DMA the encoder and decoder variables that need to be saved for the next frame in contiguous blocks.

Table 600 of FIG. 6 shows a comparison of a Manta 1×1 sequential processing embodiment in column 610 and an iVLIW implementation in column 620 of G.729A. Both versions were about 80% optimized and could yield another 10–20% less cycles if optimized further. iVLIW memory is re-usable and loaded as needed by each function from the first VIM slot. Through the use of PE masking, the code can be run in a 1×1 or 1×2 or 2×2 configuration as long as the channel data is present in each PE. The number of PEs in a 1×2 or a 2×2 should be used to divide the cycles per frame numbers in table 600, which are for a 1×1 implementation. All PEs use the same instructions and tables from the SP but would save the channel specific information in the variables in their own PE data memory.

While the present invention has been disclosed in a presently preferred context, it will be recognized that the present invention may be variously embodied consistent with the disclosure and the claims which follow below.

We claim:

1. A digital signal processor having:

N parallel processing elements;

a cluster switch mechanism connecting the N parallel processing elements;

converted code which has been converted from a standard vocoder code implementation by removing conditional jumps found in the standard vocoder code implementation said conditional jumps jump from one part of a function to another depending on the evaluation of a condition;

a sequence processor running a first portion of the converted code to control the N parallel processing elements to operate as a single instruction multiple data parallel processor array; and N channels of voice communication, one of said channels connected to each one of said parallel processing elements, the N parallel processing elements running a second portion of the converted code to process the N channels of voice communication in parallel.

2. The digital signal processor of claim 1 wherein the first portion of the converted code has a loop control for determining a number of cycles of execution performed by a parallel processing element, the loop control having a constant which is utilized to set the number of cycles, upon executing the first portion of the converted code, each parallel processing element takes the same set number of cycles of execution regardless of the data being processed by each parallel processing element.

3. The digital signal processor of claim 1 wherein the first portion of the converted code is separated from the second portion of the converted code.

4. The digital signal processor of claim 1 wherein power savings are achieved by turning a processing element off when it has finished processing its data while another processing element is still processing its data.

5. The digital signal processor of claim 1 wherein N equals four.

6. A method for efficiently implementing a vocoder in a digital signal processor comprising the steps of:

converting a standard vocoder code implementation to converted code by removing conditional jumps found in the standard vocoder code implementation, said conditional jumps causing a jump from one part of a function to another depending on the evaluation of a condition;

providing N channels of voice communication;

connecting one of said channels to one of N parallel processing elements;

communicating between the N parallel processing elements utilizing a cluster switch mechanism connecting the N parallel processing elements;

running a first portion of the converted code in a sequence processor to control the N parallel processing elements to operate as a single instruction multiple data parallel processor array; and running a second portion of the converted code in the N parallel processing elements to process the voice communication channels in parallel.

7. The method of claim 6 wherein the first portion of the converted code has a loop control for determining a number of cycles of execution performed by a parallel processing element, the loop control having a constant which is utilized to set the number of cycles so that each parallel processing element takes the same set number of cycles regardless of the data being processed by each parallel processing element.

8. The method of claim 6 wherein the first portion of the converted code is separated from the second portion of the converted code.

9. The method of claim 6 wherein power savings are achieved by turning a processing element off when it has finished processing its data while another processing element is still processing its data.

10. The method of claim 6 wherein N equals four.

* * * * *